United States Patent [19]

Pontius

[11] Patent Number: 5,022,553

[45] Date of Patent: Jun. 11, 1991

[54] TEMPORARY DIAPER STORAGE CONTAINER

[76] Inventor: Jeffrey S. Pontius, 10690 Royalton Rd., Amanda, Ohio 43102

[21] Appl. No.: 529,506

[22] Filed: May 29, 1990

[51] Int. Cl.[5] ..... B65D 90/04

[52] U.S. Cl. ..... 220/410; 220/417; 220/462; 220/470; 119/1

[58] Field of Search ..... 119/1; 220/403, 407, 220/457, 408, 410, 460, 463, 462, 417, 470

[56] References Cited

U.S. PATENT DOCUMENTS

| | | | |
|---|---|---|---|
| 3,880,341 | 4/1975 | Bamburg et al. | 206/457 |
| 4,528,222 | 7/1985 | Rzepecki et al. | 206/524.3 |
| 4,800,841 | 1/1989 | Yananton et al. | 119/1 |
| 4,869,204 | 9/1989 | Yananton | 119/1 |
| 4,934,316 | 6/1990 | Mack | 119/1 |

*Primary Examiner*—Joseph M. Moy
*Attorney, Agent, or Firm*—Francis T. Kremblas, Jr.

[57] ABSTRACT

An improved diaper container to temporarily store soiled diapers prior to final disposal thereof which is characterized by an outer fluid impervious shell provided with a removably mounted liner. The liner comprises a pad of non-woven synthetic fibers impregnated with an odor adsorbing material, such as activated carbon. The outer shell is provided with a hinged lid for access to the interior of the container and the liner is slideably mounted within the outer shell in a snut fit with the inner walls of the outer shell. The activated carbon entraps noxious odors within the liner to effectively prevent the odors from escaping from the container when it is opened.

10 Claims, 1 Drawing Sheet

36
28
26
34
32
2
30
30
2
20
3
3
30
22
30
22
24

34
28
34
36
20
22
32
24

30
22
34
24
34
22
22
22
32
22
34
30
22

40
28
36
40
42
46
32-A
34
44
22

TEMPORARY DIAPER STORAGE CONTAINER

TECHNICAL FIELD

The present invention relates generally to containers for temporarily storing soiled diapers prior to final disposal or laundering, as the case may be, and particularly to an improved container provided with a replaceable inner liner which adsorbs the noxious odors typically associated with soiled diapers.

BACKGROUND ART

Whether one uses a disposable type diaper or a washable and re-usable diaper, satisfactory and convenient temporary storage of soiled diapers prior to final disposal or laundering represents a long-felt problem.

The noxious odors emanating from soiled diapers is highly undesirable. However, it is not convenient to immediately transport each soiled diaper to an outdoor storage vessel. One hesitates to leave the infant unattended or to carry both the infant and the soiled diaper to a remote location from the area normally used to change the diaper.

A resealable plastic garbage bag or even a conventional plastic diaper pail having a tight lid only contains the odors when sealed. Upon opening the same, the noxious odors escape into the area giving an extremely unpleasant sensation to the person attempting to place another soiled diaper into the container. Diaper pails provided with a pleasant masking scent become all too quickly ineffective to mask such odors and have generally failed to solve the problem.

Locating such containers in a remote location or outdoors is inconvenient and generally unsatisfactory. Further this does not solve the problem of encountering the extremely strong odors when the container is opened to deposit another soiled diaper.

The scented diaper pail, which has been commercially available for many years, is most often placed in the nursery or other selected area where the diaper is most often changed. However, such containers tend to retain the noxious odors even after the diapers have been removed. Therefore, a thorough and complete cleaning of such a container is necessary on a regular schedule to reduce the lingering odor. However, the odor problem continues when such containers are used again to store soiled diapers.

Prior to the present invention, a storage container for soiled diapers which satisfactorily solves the odor problem in a practical and economically affordable manner has not been proposed or suggested by those skilled in this field.

BRIEF DISCLOSURE OF INVENTION

The present invention relates to the temporary storage of soiled diapers within the home residence or the like and particularly to an improved storage container, commonly referred to as a diaper pail, which effectively eliminates most, if not all, noxious odors emanating from the soiled diapers.

In accordance with the present invention, the novel diaper pail includes a permanent outer shell having a lid closure and a removable, replaceable liner slideably fit within the outer shell.

The liner comprises a pad of non-woven fibers impregnated with odor adsorbing particles, such as activated carbon, which effectively adsorb the gaseous odors typically produced from soiled diapers. It has a configuration mated with the inner surface of the side walls of the outer shell to slideably fit within the shell in a light interference fit so the contents may be emptied easily without disturbing the position of the liner.

However, the liner may also be slideably removed and a new liner replaced when its odor adsorbing capacity has been reached.

The liner pad is semi-rigid and has a generally self-supporting nature in order to be more easily inserted or removed from the outer shell of the container.

In another preferred embodiment of the present invention, the inner surface of the outer shell is provided with a lip portion disposed circumferentially below the top opening of the outer shell. The adsorbing liner has a height dimension reduced to fit under the lip portion and extend to a bottom wall of the outer shell. The lip functions as a positive retaining means to hold the liner in position when one empties the container of any soiled diapers.

OBJECTS

It is therefore an object of the present invention to provide an improved temporary storage container for soiled diapers which effectively eliminates the noxious odors produced by the soiled diapers.

It is another object of the present invention to provide a storage container of the type described which can be conveniently stored within the residence without the fear of contaminating the area with the noxious odors typically associated with soiled diapers.

It is still another object of the present invention to provide a storage container of the type described which economically incorporates a removable odor adsorbing liner with a permanent outer container shell wherein the liner adsorbs the noxious odors and prevents their escape when the outer shell is opened.

Figure 1:
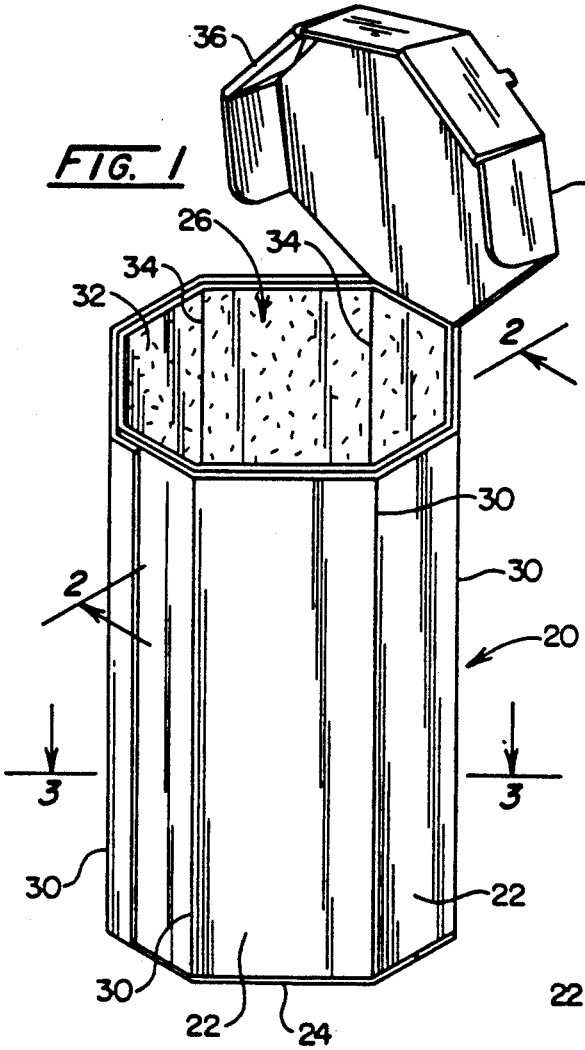
FIG. 1 is a perspective view of a diaper storage container constructed in accordance with the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

A temporary diaper storage container or diaper pail constructed in accordance with the present invention is shown in FIG. 1 and includes an outer container or shell, indicated generally at 20. Outer shell 20 includes side walls 22, a bottom wall 24, a top opening, indicated generally at 26, and a hinged lid 28 providing selective access to the interior of shell 20.

Figure 2:
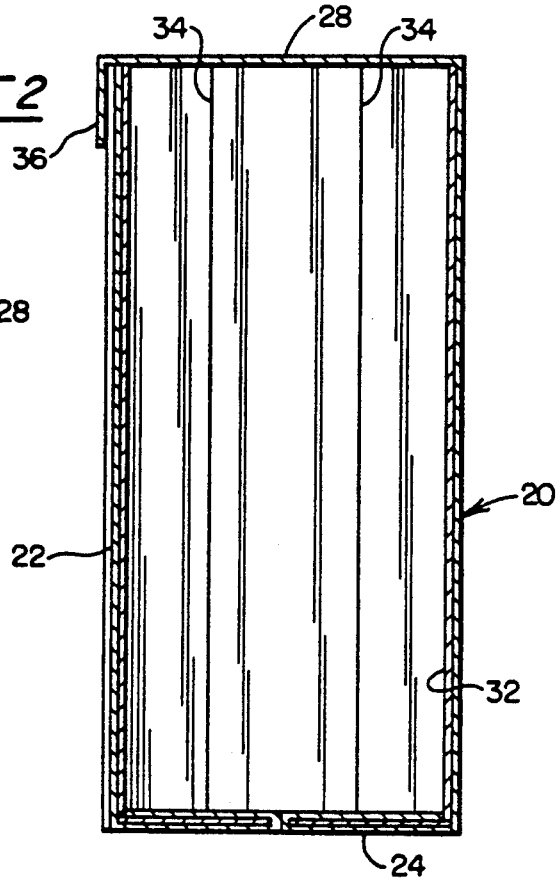
FIG. 2 is a side elevational sectional view of the container shown in FIG. 1, the section being taken along line 2—2 in FIG. 1.
Figure 3:
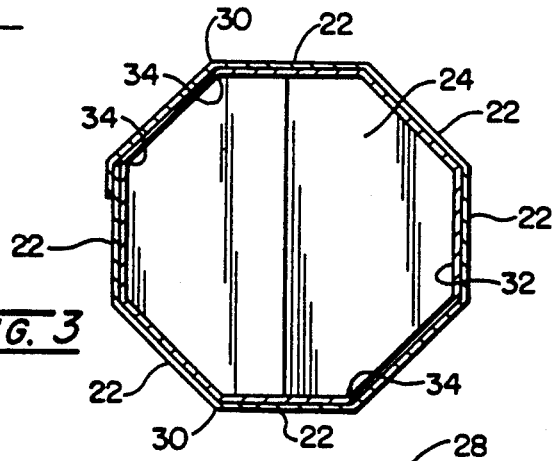
FIG. 3 is a plan view, in section, of the container shown in FIG. 1, the section being taken along line 3—3.

In one of the embodiments shown in FIGS. 1–3, outer shell 20 is fabricated from corrugated paper provided with a wax coating or other moisture-proof barrier. It is conventionally manufactured from a single cut blank which provides a folded double thickness for extra support in bottom wall 24 and includes a plurality of folds 30 forming vertical reinforcing ribs between the plural side wall sections 22 forming an octagonal shape. This shape is best seen in the configuration of bottom wall 24 as seen in FIG. 3.

This particular material and configuration is chosen primarily for its relatively inexpensive cost, yet it possesses sufficient strength to support a very satisfactory number of diapers for the intended use. A convenient capacity for the user relative to the weight of a container full of soiled diapers is estimated to be at least about 30 to 45 medium-sized diapers. Such capacity would require removal of the diapers from the storage container no more than typically once a week on the average. The diapers removed would normally be transferred to a plastic garbage bag or the like and appropriately sealed for ultimate disposal with the other trash and garbage.

However, the outer shell container may have a different specific configuration and be made of other moisture proof materials appropriate to perform the intended function without departing from the present invention. Such materials include a plastic suitable for the intended purpose.

The storage container 20 is provided with a removably mounted liner 32 capable of adsorbing an effective amount of the noxious odors emanating from soiled diapers to eliminate or dramatically reduce the offensive sensation of such odors to the user.

In the preferred embodiment shown in FIG. 1, liner 32 comprises a mat or pad formed from non-woven synthetic fibers. The liner pad 32 is impregnated with an amount of activated carbon particles using well-known conventional techniques to provide effective adsorption of the noxious gaseous products emanating from soiled diapers and the like. The effective odor adsorbing life span of the liner pad 32 depends upon the amount of activated carbon contained within the pad up to the practical limits of the impregnation process.

The liner pad 32 is also impregnated with binders and stiffening agents to impart a reasonable degree of rigidity to render the pad generally self-supporting within the limited practical size useful in a diaper pail constructed in accordance with the present invention. Liner pad 32 is initially manufactured in flat sheets. The sheets are cut and scored to a selected size and then formed into a hollow, tubular configuration to fit within outer shell 20.

The degree of stiffness or rigidity referred to above is sufficient to enable one to slideably insert liner pad 32, fully within the outer shell 20 with a light interfering or snug fit in contact with the inner surfaces of walls 22 without significant deforming of the pad or causing it to collapse. Of course, the snug fit is not so great as to prevent slideably inserting or removing a pad 32 with relative ease as necessary.

Further, the light interference fit permits the soiled diapers to be removed by merely turning the container 20 upside down to empty the contents into a trash bag or the like for permanent disposal, without inadvertently disturbing the position of the liner 32.

Liner 32 is preferably manufactured in sheet form of the desired thickness. After drying, the sheets are scored and cut to size. The they are formed into a cylinder like or tubular configuration by joining opposing ends and fixing an opposing pair of ends together by heat sealing or an adhesive. In the preferred embodiment shown in FIGS. 1–3, a plurality of vertically extending pleats, such as 34, are formed by a conventional heat sealing process and spaced to conform to the ribs 30 of the outer shell 20. This permits liner 32 to better conform to the configuration of the inner walls of outer shell 20 for the light interfering fit desired.

If the inner wall surface of shell 20 has a round or other configuration, liner 30 would be made to conform accordingly to relatively snugly engage the side walls 22.

In using the diaper storage container of the present invention, the user may locate the outer shell 20 containing the liner pad 32 in the most desirable location conveniently in or near the area used most often for changing diapers.

Closure lid 28 is provided with a downturned lip portion 36 which extends over a portion of outer shell 20 to completely close opening 26. Lip 36 also provides means for easily manipulating lid 28 to an open position.

Once the soiled diaper is placed within the container and the lid is closed, the noxious odors are substantially confined within the container. Over a relatively short period of time, the odors generated are adsorbed by the activated charcoal in liner 32 and entrapped therein. Upon opening lid 28, tests indicate no unpleasant odor can be observed by the user.

Tests results have shown that even after several soiled diapers have been placed into container 20, over an extended period of time, no noticeable odor is present upon opening lid. Further no unpleasant or noxious odor is noticeably present in the immediate area of a container 20 loaded with several soiled diapers. The gaseous products responsible for the unpleasant odors appear to be very effectively adsorbed and contained within the activated carbon in the liner.

These results contrast sharply with comparable results using conventional scented or unscented diaper pails or the like. Typically, after storage of merely a few soiled diapers, a very strong, repugnant odor is present upon opening the lid of the conventional diaper pail. Such odors overcome the masking scent present in the scented pails. The unpleasant odor which escapes upon opening the pail is also noticeable for several minutes in the surrounding area, particularly if it is relatively small, such as a typical nursery. Further, once a conventional diaper pail has been used, even after unloading the contents and cleaning the container, the empty used pail retains a lingering noxious odor.

Liner pad 32 is preferably impregnated with activated carbon using conventional well-known processes. A quarter-inch thick pad 32, loaded with about a two hundred weight percent of activated carbon based upon the unimpregnated weight of the pad, has effectively adsorbed odors for between three to four months. This effective life is based upon a typical average usage of diapers for one infant during the same period. Near the end of that period, the user will begin to notice a slight degree of lessening of the liner pad's effectiveness.

When odors begin to become slightly noticeable, this signals that a new pad 20 should be installed.

The old pad 32 is then simply removed and discarded, and a new pad 20 replaced to return the storage container to its original odor adsorbing efficiency.

While activated carbon appears to be the most economically efficient material for impregnation of pad 32, other materials, such as zeolite, which are effective to adsorb the odors of soiled diapers may be used alone or in combination with activated carbon without departing from the spirit of the present invention.

Figure 4:
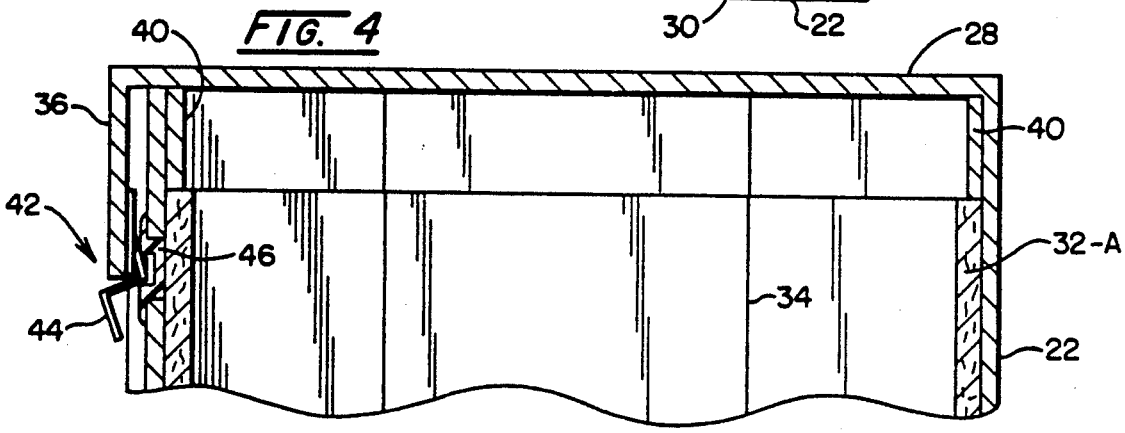
FIG. 4 is a partial side sectional view similar to FIG. 2 illustrating another embodiment of the present invention including a retaining lip on the inner surface of the outer shell.

Now referring to FIG. 4, another embodiment of the present invention is shown. The embodiment of FIG. 4 is identical to the embodiment shown in FIGS. 1–3 except for the addition of a retaining lip 40 on the inner surface of outer shell 20 and a latch mechanism 42 provided for lid 28. In FIG. 4, identical reference numerals are used for identical components as shown in FIGS. 1–3.

The retaining lip 40 consists of another layer of the identical material used to construct outer shell 20 which extends downwardly from the top edge of shell 20 only a short distance sufficient to form an inwardly extending protrusion. Lip 40 may be formed continuously around the interior of shell 20 or it may consist of a plurality of spaced ledges or lips individually connected to the inner surface of walls 22 in the same vertical plane.

Liner 32-A is modified in its vertical dimension to extend from the underside of lip 40 to the bottom wall 24 of outer shell 20. Lip 40 functions to provide means for more positive retention of liner 32-A when fully inserted, particularly when one inverts container 20 in order to dump its contents.

Preferably lip 40 is at least no wider than the cross-sectional dimension of liner 32-A so as not to unreasonably inhibit the initial insertion or the intentional removal of liner 32-A from outer shell 20.

When employing the embodiment including retaining lip 40, the degree of the interfering fit between the liner 32-A and the inner surface of side walls 22 may be slightly relaxed as lip 40 functions as a positive retaining means to prevent inadvertent removal of the liner 32-A.

Insertion of liner 32-A may be accomplished in a similar manner with relatively easy maneuvering of liner 32-A in a folded relationship along one or more of the pleats or fold lines 34 through top opening 28 and past lip 40. Once liner 32-A is partially inserted past lip 40, the user merely pushes downwardly and outwardly on the inner surface of the liner 32-A with the pleats 34 aligned with riles 30. In this manner liner 32-A may be slideably inserted fully into container 20 in engagement with the inner surfaces of side walls 22.

To remove a used liner 32-A, the user must first pull or otherwise work the upper edge of liner 32-A free of lip 40 and then simply pull the remainder of the liner outwardly through top opening 28.

Still referring to FIG. 4, a latch mechanism 42 is provided to more securely close lid 36 in a closed position. A resilient male latch member 44 is fixed to the inner lower edge of lid 36 and is conformed to mate with a female member 46 fixed within one of the side walls 22 of outer shell 20. As seen in FIG. 4, pulling outwardly on male latch member 44 releases a right-angled corner portion from engagement with the indented female member 46 to permit unrestricted opening of lid 36. Appropriate alignment permits the male latch member 44 to automatically re-engage itself with female member 46 upon closing lid 36. It should be noted that other conventional forms of a light latching mechanism could also be employed to achieve a similar positive closure of lid 36.

While certain preferred embodiments of the present invention have been disclosed in detail, it is to be understood that various modifications may be adopted without departing from the spirit of the invention or scope of the following claims.

I claim:

1. An improved container for temporary storage of soiled diapers comprising in combination;

a) an outer shell provided with side walls including inner and outer surfaces, a bottom wall, and an opening having a closable cover spaced from said bottom wall;

b) a liner removably mounted within said outer shell in force transmitting contact with the inner surfaces of said side walls of said outer shell and defining an open, centrally disposed space within said container to receive a selected capacity of said diapers, said liner impregnated with an amount of odor-adsorbing material effective to adsorb a substantial amount of noxious gaseous materials associated with soiled diapers.

2. The container defined in claim 1 wherein said liner has a hollow tubular configuration conforming closely to the configuration of the inner surface of said side walls.

3. The container defined in claim 2 wherein said liner is sufficiently rigid to define a generally self-supporting configuration.

4. The container defined in claim 1 wherein said liner is slideably mounted within said container in light, force-transmitting engagement with the inner surface of said side walls.

5. The container defined in claim 1 wherein said odor adsorbing material is activated carbon.

6. The container defined in claim 1 wherein said container comprises a one-piece paper board material provided with at least five or more vertical reinforcing ribs extending along said side walls.

7. The container defined in claim 6 wherein said liner includes a plurality of vertical reinforcing ribs, each aligned with a respective one of said ribs formed in the side wall of said container.

8. The container defined in claim 1 wherein said liner is a pad of non-woven synthetic fibers.

9. The contained defined in claim 1 wherein said outer shell includes an inwardly extending retaining lip adjacent to said opening and a top edge of said liner is disposed under said lip to resist inadvertent removal of said liner from said outer shell.

10. The container defined in claim 1 wherein said liner comprises a pad of non-woven synthetic fibers impregnated with activated carbon having a configuration conforming closely to the side walls of said outer shell, said configuration being sufficiently rigid to define a generally self-supporting structure slideably received in light force transmitting engagement with the inner surface of said side walls.

* * * * *